United States Patent [19]

Grow

[11] 4,070,998

[45] Jan. 31, 1978

[54] COMPRESSION IGNITION CONTROL PRESSURE HEAT ENGINE

[76] Inventor: Harlow B. Grow, 16530 Chattanooga Place, Pacific Palisades, Calif. 90272

[21] Appl. No.: 625,676

[22] Filed: Oct. 24, 1975

[51] Int. Cl.[2] ..... F02B 41/00

[52] U.S. Cl. ..... 123/26; 123/37

[58] Field of Search ..... 123/32.5, 37, 26, 75 B

[56] References Cited

U.S. PATENT DOCUMENTS

| | | | |
|---|---|---|---|
| 1,585,377 | 5/1926 | Cromwell | 123/37 |
| 2,114,924 | 4/1938 | Kahllenberger | 123/26 |
| 2,312,500 | 3/1943 | Smith | 123/26 |

FOREIGN PATENT DOCUMENTS

| | | | |
|---|---|---|---|
| 286,035 | 5/1931 | Italy | 123/37 |

*Primary Examiner*—Ronald H. Lazarus

[57] ABSTRACT

A fuel injected heat engine of the reciprocating type wherein a piston moves reciprocally within a cylinder to compress gases for the support of combustion and to be moved by burning gases to turn a crank with torque, there being a low compression storage chamber of substantial volume normally open into the cylinder and closed by upward movement of the piston to withhold gases at combustion supporting temperature, there being a high compression auto ignition chamber of limited volume comprising the upper portion of the cylinder and isolated from said low compression chamber by said piston closure thereof for continued compression of combustion supporting gases by said piston movement to auto ignition temperature, and there being constant volume fuel injection means for injecting fuel at high pressure into the auto ignition chamber and at a progressively diminishing rate as the first mentioned storage chamber is re-opened and as the cylinder pressure decreases during the effective power stroke.

6 Claims, 4 Drawing Figures

COMPRESSION IGNITION CONTROL PRESSURE HEAT ENGINE

BACKGROUND

The prior art accepts, generally, the Otto cycle and Diesel cycle internal combustion engines, the former being constant volume and the latter being constant pressure, in theory. The constant pressure concept is much to be desired but is available only in theory with engines that compress the full cylinder volume and inject a full measurement of fuel at or during travel of the piston-crank through the top dead center position. At the present state of the art, compression ignition engines, Diesels, are acknowledged to compress 40% excess air in order to establish auto ignition temperature at the top of the piston stroke, and although this has its benefits in providing more than adequate support for combustion, it has great disadvantages in the waste of energy provided for the compressive function and in the increased structural requirements of large volume high compression engines; and all of which involves inefficiency which entails friction and heat losses. Therefore, it is an object of this invention to provide an internal combustion heat engine of the cylinder and piston type wherein a substantial portion of the compression is restricted to low pressure for support of combustion, and wherein a limited portion of the compression is extended to high pressure for establishing auto ignition. With the concept herein disclosed, the aforementioned 40% excess air is reduced to a minimum and/or to a small excess, say for example 10 to 15% or less as may be desired; and the engine structure is commensurately reduced in heft with corresponding decrease in construction costs and with increases in efficiency.

The engine of the present invention is a departure from the Otto cycle in that auxiliary ignition means and an explosive power stroke are avoided, and is a departure from the Diesel cycle in that full volume compression and measured fuel injection at the beginning of the power stroke are avoided. Replacing the foregoing is controlled injection applied in a manner which identifies the present invention as a Compression Ignition Controlled Pressure Heat Engine. To this end it is an object of this invention to continuously inject fuel throughout the effective portion of the work stroke, at a controlled rate establishing burning pressures less than the pressure of the aforementioned storage air that is thereby releasable from the aforementioned storage chamber to support combustion within the cylinder.

An object of this invention is to advantageously employ the constant volume variable potency injectors as disclosed in U.S. Pat. No. 3,749,097 issued to me on July 31, 1973 and U.S. Pat. No. 3,921,599 issued to me on Nov. 25, 1975. It is by means of these fuel injectors, or like injectors, that controlled fuel burning and cylinder pressures are maintained below the stored combustion supporting air pressures. With this invention a constant volume pump intermixes two liquid and discriminately injects the admixture thereof discretely therefrom and into the engine cylinder at a controlled potency. The injector per se is characterized by its differential pump means which are advantageously employed to acquire structural strength and accurately metered fuel injection.

FIELD OF INVENTION

This invention relates to internal combustion engines wherein intake gases for support of combustion are compressed to auto ignition temperature, and in accordance with this invention a substantial volume of said gases is stored at low compression while a minimized volume thereof is highly compressed to auto ignition temperature. Although this concept is applicable to two cycle as well as four cycle engine types, it will be described as embodied in the latter type for clarity in separating the intake, dual compression, power and exhaust functions. And, as depicted in the Pressure Volume diagram of FIG. 3 it will be seen that the compression function of the diagram is characterized by a volume storage line *a* where a compressed volume is stored at a pressure, while the compression curve continues as indicated by line *b* to compress a remaining volume to auto ignition temperature. Continuing its power function, the diagram of FIG. 3 depicts the compression ignition of injected fuel, followed by continued combustion supported by the aforesaid stored compressed volume of intake gases and depicted by line *c* representing cylinder pressure and by line *d* representing storage chamber pressure. Notice that the latter storage chamber pressure *d* exceeds the former cylinder pressure *c* at all times, so that there will be flow from said chamber into the cylinder where combustion takes place. A feature of this engine concept is the controlled injection through the use of variable potency fuel injected throughout the power stroke, only a small portion of the fuel being injected into the auto ignition chamber and the greater portion of the fuel being injected as required to burn stored air and to maintain the cylinder pressure curve *c*. The area within the diagram envelope represents the power, the primary purpose of this Controlled Pressure concept being to obtain compression ignition without subjecting the engine to the compression ignition pressures that heretofore resulted from the handling of 40% excess air. Further, by controlled potency and rate of fuel injection, a diminishing pressure heat engine with improved torque characteristics is realized. DRAWINGS The various objects and features of this invention will be fully understood from the following detailed description of the typical preferred form and application thereof, throughout which description reference is made to the accompanying drawings, in which:

PREFERRED EMBODIMENT

Figure 2:
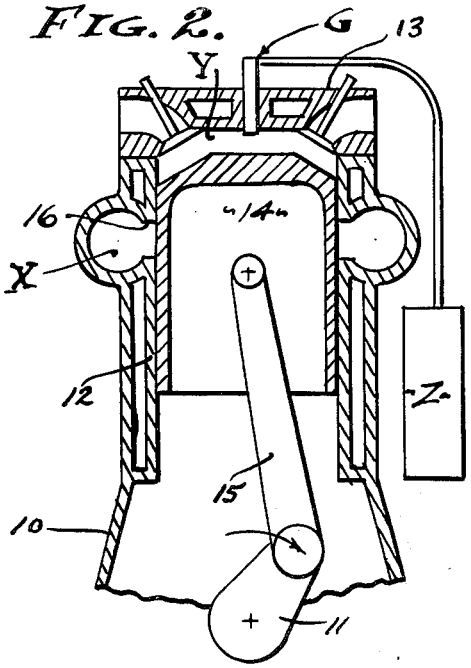
FIG. 2 is a view similar to FIG. 1 showing the engine on the power stroke.
Figure 4:
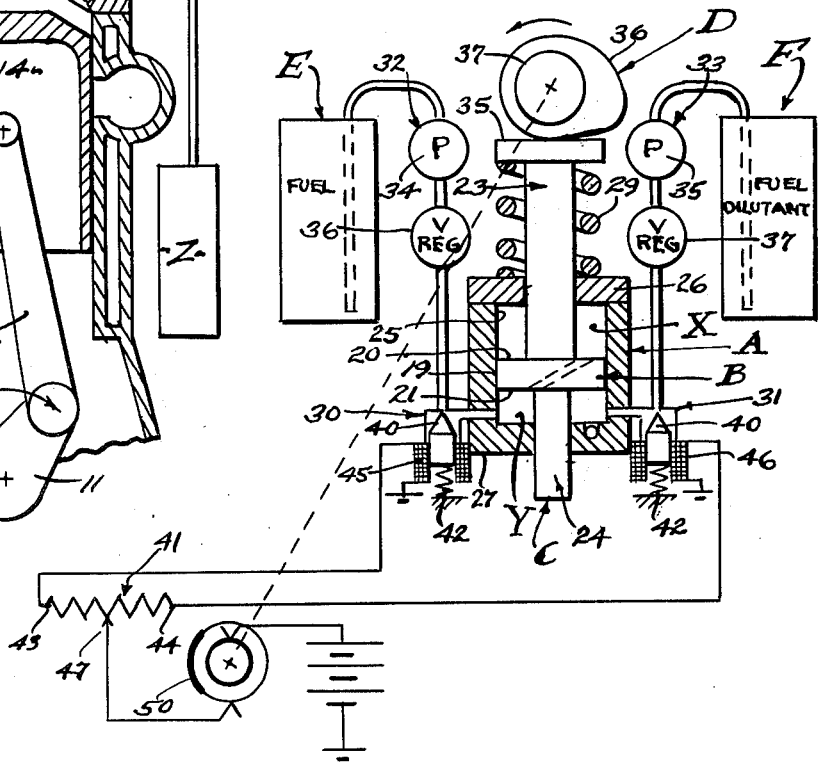
FIG. 4 is a schematic diagram illustrating the full stroke fuel pump means.

This disclosure requires an understanding of the Pressure Volume diagrams as they are depicted graphically on indicator cards and as shown in FIG. 2 of the drawings. The envelope curve illustrates what is generally referred to as the "constant pressure" Carnot Cycle of the Diesel engine, showing ignition lag followed by the usual sharply rising peak pressures resulting from the explosive character of the auto ignition. A typical four cycle diagram is illustrated and modified according to the present invention to show the diminishing pressure relationship between cylinder pressure *c* and compression storage chamber pressure *d*, all as a result of storage of a substantial volume of combustion supporting gases in what will be termed a low compression storage chamber X and using the same during the power cycle, after auto ignition by means of compressing a limited volume of gases in the ignition chamber Y comprising the upper portion of the cylinder.

Figure 1:
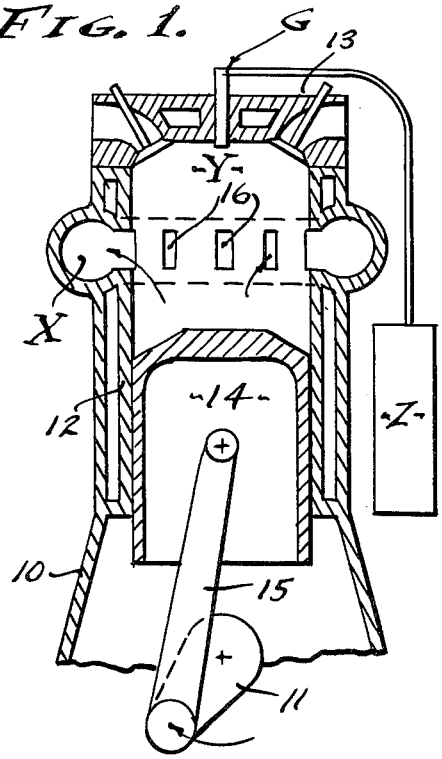
FIG. 1 is a cross sectional elevation of a fundamental compression ignition engine shown on the compression stroke.
Figure 3:
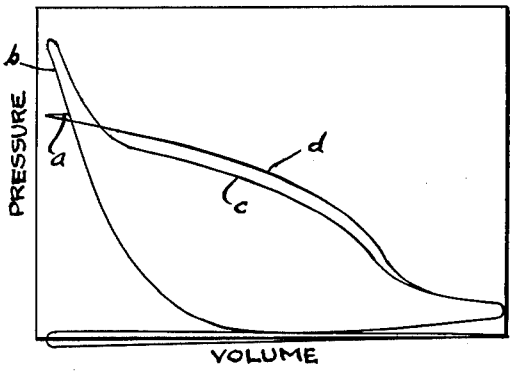
FIG. 3 is a Pressure Volume diagram illustrating the operation of the engine.

Referring to FIG. 1 of the drawings, the compression ignition engine can vary widely and in each instance involves a frame 10 journaling a crank shaft 11 and carrying a cylinder 12 closed by a head 13 and in which a piston 14 reciprocates according to the angular displacements of the crank connected to the piston by a rod 15. In accordance with this invention, I provide a constant volume variable potency fuel injection means Z operating in timed relation to rotation of the engine to inject fuel into the auto ignition chamber Y. Referring to FIG. 3, the low compression storage chamber X opens through ports 16 into the cylinder 12 at a position substantially above the bottom dead center position of the piston 14 and below the top dead center position thereof. The position of the ports 16 will depend upon the percentage volume of compressed intake air to be stored as compared with the volume intake air to be finally compressed for auto ignition in chamber Y.

The total swept volume of the cylinder 12 is not compressed in the usually accepted manner. It is generally accepted that full swept volume of a Diesel cylinder, for example, will compress about 40% air in excess of that required by combustion, and therefore any compressed air stored when the piston 14 is at or passed through an intermediate position will reduce the said percentage of excess air. In the Pressure Volume diagram of FIG. 2 the position of ports 16 are indicated such that they are closed by piston 14 between 80 and 90% of volume, in which case 10% of the partially compressed intake air remains in the auto ignition chamber Y for final compression, the low compression storage chamber ports 16 being closed by the piston 14 to entrap the said 80–90% partially compressed or low compression intake air as represented by line *a*.

From the foregoing it will be seen that the minimized, for example 10%, intake air that is compressed to auto ignition temperature will ignite injected fuel as the piston 14 passes over the top dead center position, and due to the minimized volume (10%) of compressed intake air it will be apparent that combustion of a customary full metered amount of fuel will not be supported. Furthermore, a customary full metered amount of fuel at top dead center position of the piston 14 would work detrimentally with respect to the present invention as and when the ports 16 are re-opened on the downward power stroke, since cylinder pressure in excess of storage chamber pressure would prevent re-entry of storage air resulting in inadequate support of continued combustion. Therefore, and in accordance with the present invention, the constant volume variable potency fuel injection means Z is provided to continuously inject fuel throughout the power stroke and such that cylinder pressure never exceeds storage chamber pressure as clearly depicted by the comparable lines *c* and *d* in the Diagram. Thus, compressed stored intake gases for the support of combustion are assured of re-entry into the cylinder 12 when the ports 16 are uncovered by piston 14 and throughout the remainder of the downward power stroke.

Referring to the low compression storage chamber X for withholding a substantial portion of the intake air from full compression to auto ignition pressure and/or temperature, the cylinder 12 is provided with one or more circumferentially disposed ports 16 positioned intermediate the top and bottom dead center positions of the piston 14 that reciprocates therein. The longitudinal extent of the port or ports 16 can vary according to design, with the top or tops thereof determining the cut-off position where the pressure of the stored intake air is determined, in the example shown at 90% of volume. In practice, the ports 16 are in the form of a "lantern ring," the piston 14 having rings (not shown) to seal above and below the ports on the up stroke above said 90% volume position. As shown, the chamber X is a closed chamber that surrounds and is re-opened only into the cylinder 12 through the ports 16 when the piston 14 is on the downstroke below said 90% volume position. It will be seen that the chamber X breaths intake air through the ports 16. It is to be understood that a multiplicity of or a singular storage chamber X can be disposed laterally at any position around the cylinder and/or along its diameter, for the opening and closing of the port or ports 16 at the piston position desired, for example including ports to be opened and closed sequentially by reciprocal movement of the piston.

Referring to the high compression auto ignition chamber Y for continuing compression of a minimized portion of the intake air to full compression, the cylinder head 13 with conventional valve gear and injector of the means Z is provided to cooperate with the piston 14 after the ports 16 are closed on the upstroke above the 90% volume position. Therefore, the chamber Y is a conventional combustion chamber, in this instance a primary combustion chamber handling a minimized 10% of the swept volume of the cylinder 12, and subjected therefore to commensurately minimized stress.

Referring to the constant volume variable potency fuel injection means Z, a constant stroke and constant volume differential ram pump is operated in timed relation to the engine crankshaft rotation. The structural functions are: low pressure metering and homogenous mixing together of discretely small amounts of at least two liquid fuels, one of maximum potency and one of lesser or minimum potency such as a dilutant and/or other additive as may be required; the averaging of power through multiple power strokes or revolutions, and the constant volume injection which results in full stroke fuel injection and reduced peak pressure; all of which is due to the controllability of relatively small discrete amounts of liquid to be injected. Fuel is injected constantly throughout the effective work stroke of the piston.

The constant volume injection principle is utilized herein, to the end that the Pressure Volume curve of the engine is controlled, and as a consequence making it possible to maintain a cylinder 12 pressure *c* lower than the storage chamber X pressure *d*. The injected fuel is a homogenous mixture of at least two liquids, one such as oil or fossil fuel with its full compliment of constitutents and properties which afford a maximum power potential commonly rated in British Thermal Units, and one such as water (preferably treated, for example modified or pure or distilled water) with its lesser potency or inert or partially inert properties insofar as combustibility is concerned. In addition to the use of fossil fuels mixed with water, I contemplate the mixture of alcohol and like fuels with water; wherein the water-alcohol will serve as the idling mixture and will have anti-freeze properties. The potency of each power injection is averaged whereby sudden changes are made impossible, while the fuel potency increase or decrease is effected without unreasonable delay, by design in proportioning the differential pump ram as related to the cylinder displacement into which the fuel is injected, and all to the end that peak pressures are reduced so that lighter weight engine structures become permissible, while increasing the potential power output through all speed ranges due to the closer realization of a true constant pressure Diesel cycle.

Each pumping device involves a pump cylinder A, a partition B separating the cylinder into dual chambers, a differential ram C entering the dual chambers respectively and positioning the partition B in the cylinder A, means D reciprocating the same in timed relation to rotation of the engine, a metered fuel supply means E, a metered fuel dilutant supply means F, and a valved injector means G opening into the engine cylinder.

The dual chambers are, a transfer chamber in which the fuel and fuel dilutant are mixed, and a storage chamber in which fuel mixture not injected is re-mixed and stored. The re-mixing and storage concept provides for an averaging of fuel-dilutant potency over a number of engine cycles dependent upon the swept volumes of the said chambers. In practice, the transfer chamber which receives and delivers fluids can have a substantially complete swept volume, whereas the storage chamber which stores previously metered fuel and fuel dilutant has a remaining unswept volume thereby holding consecutively metered charges of fuel-dilutant mixture or portions thereof and mixing and averaging them over a number of engine cycles.

The pump cylinder A has an inner diameter wall 25 accurately turned about a central axis, the cylinder opening having substantial length and closed at opposite ends by heads 26 and 27, at least one of which is removable for disassembly. The partition B is preferably a piston that is operable in the cylinder A and has an outer diameter wall 19 accurately turned about the central axis and of substantially lesser length than the distance between the heads of the cylinder. The differential ram C that enters the cylinder A is effective in its movement upon the fluids in the aforementioned dual chambers, having differentially sized ram pistons 23 and 24 operable through the heads 26 and 27. The means D reciprocating the ram C in timed relation to rotation of the engine can vary in form and construction and it is shown as a cam and tappet drive means.

In accordance with this invention the ram has a tappet 35 to engage and follow a cam 36 that revolves with a shaft 37 driven at half engine speed (four cycle timing) through timing gears (not shown), the latter being driven by the crankshaft 11. It will be apparent how the lobe of the cam 36 shifts the tappet 35 so as to project the larger ram piston 23 of differential ram C into the uppermost chamber and thereby move the partition B so as to augment said uppermost chamber while diminishing the lowermost chamber while the total displacement is diminished. A return spring 29 returns the tappet, a characteristic feature being control by the shape of cam 36 which is designed to inject fuel at a rate to establish the cylinder pressure curve *c* that diminishes always at a pressure below that of the storage chamber pressure curve *d*. The rate of injection as determined by the shape of cam 36 will vary with engine design, to follow and/or establish the pressure curve *c*.

The metered fuel supply means E and metered fuel dilutant supply means F operate cooperatively to supply or replenish a full injection charge to the uppermost chamber following each constant volume injection therefrom. To this end, the means E involves a valve 30 adapted to intermittently admit fuel, and the means F involves a valve 31 adapted to intermittently admit fuel dilutant. Essentially, the valves 30 and 31 are alike and are opened in inversely balanced degree or for variably balanced time intervals; all for the purpose of completely replenishing the augmenting lowermost chamber. Accordingly, the means E supplies fuel, for example oil, from a constant pressure supply 32; while the means F supplies dilutant for example inert liquid such as mineral oil or water, from a constant pressure supply 33. Depending upon the liquid viscosities involved, the said constant pressures are set at suitable levels and/or the liquids are supplied through orifices of suitable diameter.

Constant pressure is established by means of pumps 34 and 35 that deliver the liquids through pressure regulators 36 and 37 respectively. The amount of delivered liquid in each instance can vary according to the time during which the valves 30 and 31 are fully opened. An electrical potential applied to retract the needle of valve 30 from the valve seat and against a return spring 42 opens each valve inversely varied amounts. The said electrical potential is controllably determined by a rheostat 41 wherein the opposite terminals 43 and 44 of the resistance are connected to valve opening solenoids 45 and 46 respectively, and wherein the moving contact 47 thereof operates between the said terminals. A contactor 50 revolves with the shaft 37 and cam 36 and which conducts current during the intake stroke of the differential ram C and partition B.

The valved injector means G involves a nozzle that opens into the engine cylinder 12 at the combustion chamber Y thereof, and has a check valve (not shown) that prevents the return of fuel-dilutant mixture into the injector. Consequently, the delivery is forward at all times through a tube or the like which delivers a suitably potent charge into the engine cylinder for burning.

From the foregoing it will be seen that the intake air for support of combusting injected fuel is proportionately divided into separate bodies, one that is stored at a low or moderate compression suitable for the support of combustion of ignited fuel at diminishing pressures, and the other that is highly compressed to auto ignition temperature. In carrying out this invention, the volume of the lower pressured stored air is maximized while the volume of the highly compressed auto ignition air is minimized; the aforesaid 90% to 10% ratio being a typical example only. To these ends therefore, the longitudinal or height position of the port or ports 16 is selected so as to entrap intake air compressed to combustion supporting pressure, such as for example to a pressure employed for explosive combustion in Otto cycle engines. Further, the positioning of the port or ports 16 is selected to entrap intake air for continued compression to auto ignition temperature, such as for example to a pressure employed for auto ignition in Diesel cycle engines. In practice, the auto ignition chamber Y is proportioned and/or sized to initiate combustion at the beginning of the power stroke, during which there is controlled fuel injection supported by the volume of intake air compressed into said auto ignition chamber, and in practice a minor proportion of fuel is injected during this initial portion of the power stroke. Subsequently, as the power stroke progresses and port or ports 16 are opened by piston 14, the substantial volume of storage air from chamber X is made available to re-enter the cylinder 12, following which there is continued controlled fuel injection supported by the volume of intake air previously compressed into said storage chamber, and in practice the major proportion or balance of fuel. The cam 36 of the constant volume variable potency fuel injection means Z determines the rate of burning within cylinder 12 and thereby controls the pressure therein so that it complies with the diminishing cylinder pressure curve *c* that remains below or less than the commensurately diminishing storage pressure curve *d*. Thus, force is constantly applied throughout the power stroke of the engine, initiated by ignition in the auto ignition chamber Y and followed by and continued at diminishing pressure determined by the storage air pressure that re-enters the cylinder 12 from the storage chamber X.

Having described only the typical preferred form and application of my invention, I do not wish to be limited or restricted to the specific details herein set forth, but wish to reserve to myself any modifications or variations that may appear to those skilled in the art:

I claim:

1. A compression ignition and controlled diminishing pressure cycle heat engine wherein a piston reciprocates in a cylinder and is acted upon by the expansion of burning fuel to perform work, and including; drive means coupled to the piston for reciprocation of said piston in the cylinder between bottom and top dead center positions, a port opening into the cylinder intermediate the top and bottom dead center positions of said piston and adapted to be opened and closed by downward and upward movement of said piston respectively, a closed storage chamber in open communication with the port for the exit and re-entry of gases from and into the cylinder, the port being positioned for closure by the piston and the entrappment of gases in the said storage chamber at combustion supporting pressure, an auto ignition chamber of minimized volume between said port and a head closing the top end of the cylinder for compression of gases to ignition temperature, and a full stroke fuel pump means injecting fuel into the cylinder from the top position of the piston and substantially throughout its effective work stroke, said port being opened by the piston for re-entry of gases from said storage chamber for support of continued combustion of fuel.

2. The compression ignition and controlled diminishing pressure cycle heat engine as set forth in claim 1, wherein the full stroke fuel pump means comprises control means restricting fuel injection to effect combustion pressures less than the storage chamber pressures.

3. The compression ignition and controlled diminishing pressure cycle heat engine as set forth in claim 1, wherein the full stroke fuel pump means comprises control means variably restricting the rate of fuel injection to effect diminishing combustion pressures less than diminishing storage chamber pressures.

4. The compression ignition and controlled diminishing pressure cycle heat engine as set forth in claim 1, wherein the full stroke fuel pump means comprises a cam control means operated synchronously with operation of the engine and variably restricting the rate of fuel injection to effect diminishing combustion pressures less than diminishing storage chamber pressures.

5. The compression ignition and controlled diminishing pressure cycle heat engine as set forth in claim 1, wherein the full stroke fuel pump means operates at a constant volume and comprises, a pump body having closed dual chambers therein, a transfer chamber and a storage chamber, there being restricted fluid communication between the transfer chamber and the storage chamber, fluid displacement means entering into the said storage chamber to change the volumetric displacement thereof, means reciprocating the said fluid displacement means into said storage chamber in timed relation to cycling of the engine, a metered fuel supply means and a metered fuel dilutant supply means both opening into the said transfer chamber and charging the same with fuel and fuel dilutant respectively in proportionate quantities and in timed relation to cycling of the engine and nozzle means opening from the said transfer chamber and into the combustion chamber of the engine.

6. The compression ignition and controlled diminishing pressure cycle heat engine as set forth in claim 1, wherein the full stroke fuel pump means operates at constant volume and comprises, a pump body having closed dual chambers therein, a transfer chamber and a storage chamber, there being restricted fluid communication between the transfer chamber and the storage chamber, differentially sized fluid displacement means entering into the said transfer chamber and storage chamber to reversely change the volumetric displacements thereof respectively, means reversely reciprocating the said fluid displacement rams into said transfer and storage chambers in timed relation to cycling of the engine, a metered fuel supply means and a metered fuel dilutant supply means both opening into the said transfer chamber and charging the same with fuel and fuel dilutant respectively in proportionate quantities and in timed relation to cycling of the engine, and nozzle means opening from the said transfer chamber and into the combustion chamber of the engine.

* * * * *